US005207295A

United States Patent [19]

Bialy et al.

[11] Patent Number: 5,207,295

[45] Date of Patent: May 4, 1993

[54] LIGHTWEIGHT PREFABRICATED ELEVATOR CAB

[75] Inventors: Louis Bialy, Simsbury; Eric G. Olsen, Woodbury, both of Conn.

[73] Assignee: Otis Elevator Company, Farmington, Conn.

[21] Appl. No.: 771,020

[22] Filed: Oct. 1, 1991

[51] Int. Cl.[5] ..... B66B 9/00

[52] U.S. Cl. ..... 187/1 R; 160/351

[58] Field of Search ..... 187/1 R; 160/135, 351; 52/30, 228

[56] References Cited

U.S. PATENT DOCUMENTS

| | | | |
|---|---|---|---|
| 3,356,403 | 12/1967 | Sak et al. | 160/351 |
| 3,631,942 | 1/1972 | Brown | 187/1 R |
| 3,889,736 | 6/1975 | Finks | 160/351 |
| 4,357,993 | 11/1982 | Halpern et al. | 187/1 R |
| 4,708,222 | 12/1987 | Bills et al. | 187/1 R |
| 4,779,707 | 10/1988 | Smith et al. | 187/1 R |
| 4,949,490 | 8/1990 | Miller | 160/135 |
| 4,956,953 | 9/1990 | Bates | 160/135 |

*Primary Examiner*—Robert P. Olszewski
*Assistant Examiner*—Kenneth Noland
*Attorney, Agent, or Firm*—Lloyd D. Doigan

[57] ABSTRACT

A lightweight, prefabricated elevator cab is provided having a wall structure with a plurality of panel sections connected to one another by hinge seams. The integrally attached hinge seams and the panel sections are formed from the same homogeneous material. The hinge seams are capable of being elastically deformed.

12 Claims, 4 Drawing Sheets

LIGHTWEIGHT PREFABRICATED ELEVATOR CAB

DESCRIPTION

1. Technical Field

This invention relates to elevators and more particularly to elevator cabs.

2. Background Art

In elevator systems, passengers ride in an elevator car suspended within the hoistway of the elevator. The elevator car includes a cab section and a platform. The cab section rests atop the platform, to which lifting equipment is typically attached. The lifting equipment, which lowers and raises the car within the hoistway, may consist of sheaves, cables, and drives or alternatively a hydraulically powered arrangement.

Typically, the cab section begins with a skeletal structure of rigid members. The individual rigid members are passed through a narrow hoistway door opening during assembly of the skeletal structure. Wall panels, which vary depending on the application, are subsequently attached to the "skeleton", thereby forming the wall structure of the cab section. Once the structure is complete, control panels, hardware, and lighting fixtures are installed within the cab. On-site cab construction as described is generally time consuming and expensive.

Cab sections comprising a rigid support structure and wall panels tend to be heavy. The excessive weight results from the inability of the wall panels to support themselves. Heavy cabs require sturdier elevator components including, most significantly, more powerful elevator drives, which are more expensive to initially purchase and then to later operate. Moreover, in hydraulic elevators excessive weight is even more significant because no regeneration is available and therefore the hydraulic cylinder lifts the entire weight of the cab and the load.

In sum, what is needed is a cab for an elevator car which minimizes installation cost and maximizes operating efficiency.

DISCLOSURE OF THE INVENTION

It is, therefore, an object of the present invention to provide a lightweight elevator cab which, by its' reduced weight, increases the efficiency of the elevator.

It is a further object of the present invention to provide a prefabricated elevator cab which minimizes construction costs.

It is a still further object of the present invention to improve the acoustic barrier properties of an elevator cab.

It is a still further object of the present invention to provide an elevator cab that may be installed partially assembled, thereby minimizing assembly time and consequently cost.

According to the present invention, a lightweight, prefabricated cab is provided which can be temporarily, elastically deformed to allow the cab to pass through the hoistway entrance and into the hoistway.

According further to the present invention, a wall structure is provided which includes a plurality of panel sections, containing one or more hinge seams. The hinge seam(s) possess greater flexibility than the panel sections, thereby allowing the wall structure to be temporarily, elastically deformed, by bending the structure at the hinge seam(s).

According to one aspect of the present invention, a stiffening assembly is provided which communicates with the wall structure. The stiffening assembly adds rigidity to the hinge seams, thereby increasing the rigidity of the entire wall structure.

According to another aspect of the present invention a wall structure material is provided which is a blow-molded, injection-molded, or otherwise formed plastic or composite material. The wall structure is constructed in a single or multi-layer design and is capable of structural self support.

An advantage to the present invention is the increased efficiency a lightweight cab enjoys over the heavy style cabs known in the art. A lighter cab, and consequently lighter car, consumes less drive energy. Moreover, a lightweight cab permits the use of less powerful drives and less massive sheaves. Elevator manufacturing costs are therefore reduced.

A further advantage of the present invention is the present invention's deformable design. The design permits the wall structure to be installed in the hoistway in a prefabricated state. Fabricating the wall structure in a "friendly environment" such as a manufacturing facility, as opposed to on-site within the hoistway, allows the elevator cab to be constructed more efficiently, therefore less expensively.

A still further advantage of the present invention is the improved acoustic barrier properties inherent in the deformable design of the present invention. The integral hinge seams of the wall structure minimize the need for seals and joint fillers, and their associated acoustic problems.

A still further advantage of the present invention is that the present invention may be installed partially assembled. The deformable design of the present invention allows peripheral hardware such as lighting fixtures, vents, blowers, operating panels, trim panels, and drive assemblies for elevator doors to be installed prior to the installation of the cab within the hoistway. Here again, installing the hardware in a "friendly environment" minimizes the cost of building the elevator.

These and other objects, features, and advantages of the present invention will become more apparent in light of the detailed description of the best mode embodiment thereof, as illustrated in the accompanying drawings.

BRIEF DESCRIPTION OF THE DRAWINGS

FIG. 3 shows the top view of the folded cab as well as the phantomed outline of the cab unfolded.

FIG. 4 shows the flange molded within the panel section and FIG. 4A shows an independent flange attached to a panel section.

BEST MODE FOR CARRYING OUT THE INVENTION

Figure 1:
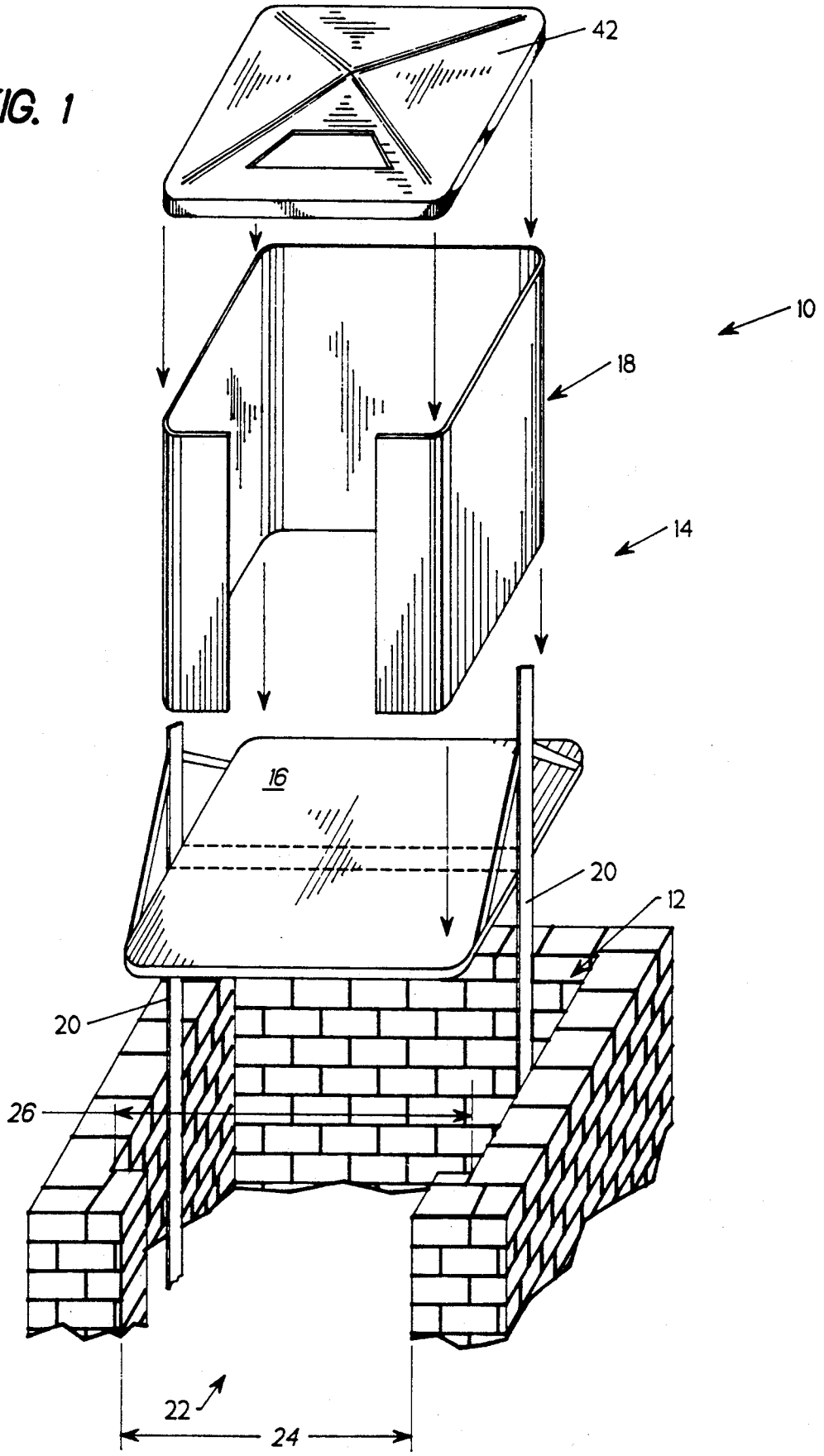
FIG. 1 shows an exploded view of an elevator car, having a cab and a platform, positioned within a hoistway of an elevator.

Now referring to FIG. 1, an elevator 10 comprises a hoistway 12 and an elevator car 14. The elevator car includes a platform 16 and an attached cab 18 which travel along rails 20 located within the hoistway. The hoistway typically includes door openings 22 positioned at each floor of the building (not shown). The width 24 of the door opening 22 is less than the width 26 of the hoistway.

Figure 2:
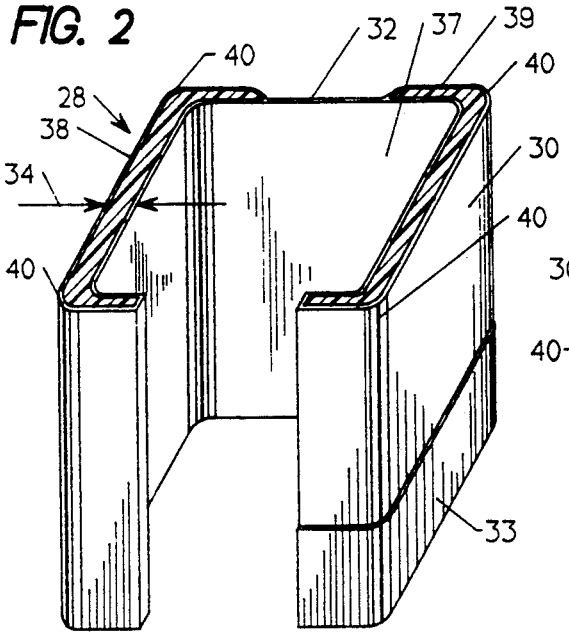
FIGS. 2, 2A, and 2B shows the elevator cab of FIG. 1.
Figure 2A:
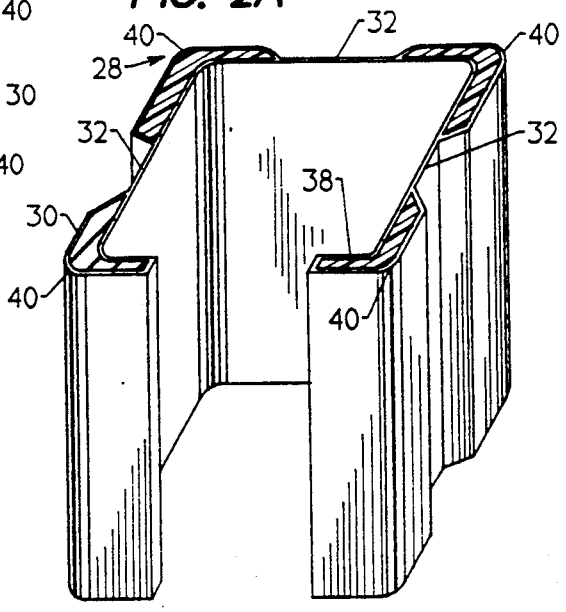
Figure 2B:
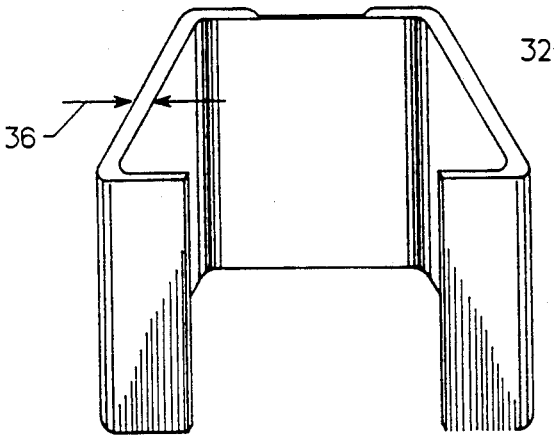

Now referring to FIG. 2, 2A and 2B, the elevator cab 18 is constructed from a plastic or composite wall structure 28 that includes a plurality of panel sections 30 and at least one integrally attached flexible hinge seam 32 capable of being elastically deformed. The wall structure has a multi-layer cross-section 34 which is formed by either blow-molding, injection-molding, or otherwise forming a plastic such as polyurethane, polyethylene, or polyvinyl chloride (PVC). In other words, the wall structure in this embodiment would be a homogeneous material molded or extruded into a specific cross-section geometry for strength purposes. Applicants define homogeneous as "uniform in composition throughout" (American Heritage Dictionary ©1976 ). The integrally attached hinges, in this embodiment are formed of the same homogeneous material, yet they have a cross-section which enable them to be elastically deformed. The wall structure material may alternatively be integrally combined with fibers or a mesh substrate for added strength. In a second embodiment, the wall structure has a single layer cross-section 36. Here again, the wall structure is formed of a homogeneous material. In this embodiment, however, the cross-section is a single layer alone. Either the single-layer or the multi-layer configuration may also include a metal panel 33 attached to the exterior surface of the wall structure 28 for fire prevention purposes.

In the preferred embodiment, the panel sections 30 of the wall structure 28 contain a filler material 38 such as foam to improve the acoustic, heat transfer, and/or flame retardant properties of the wall structure. Other embodiments may employ different filler materials such as plastic, carbon fiber, or styrofoam depending on the requirements of the application. The inner 37 and outer 39 layers of the wall structure material hold the filler material within the panel sections. The wall structure material also forms the integrally attached hinge seam(s) 32. Other embodiments may not include the filler material within the cross-section of the wall structure.

In the preferred embodiment, the corner sections 40 of the wall structure 28 serve as rigid columns capable of bearing the load of a cab roof 42 (FIG. 1) and whatever additional weight safety standards dictate as necessary. A single hinge seam 32 separates two rigid panel sections 30, thereby permitting the wall structure 28 to be folded to a configuration of minimal dimensions. Alternatively, the panel sections may serve as columns and bear the load applied to the cab 18. Accordingly, more than one hinge seam may be employed to facilitate the folding.

Figure 3:
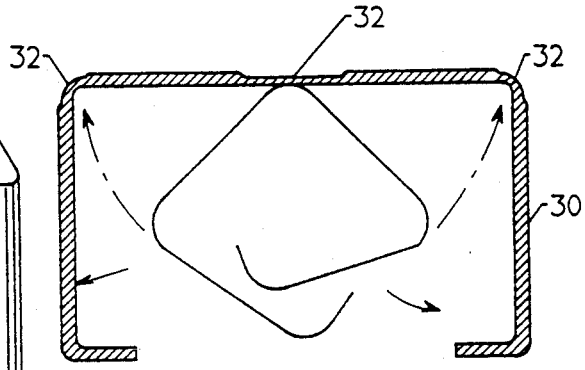
FIGS. 3, 3A and 3B show the elevator cab of FIG. 1 folded.
Figure 3A:
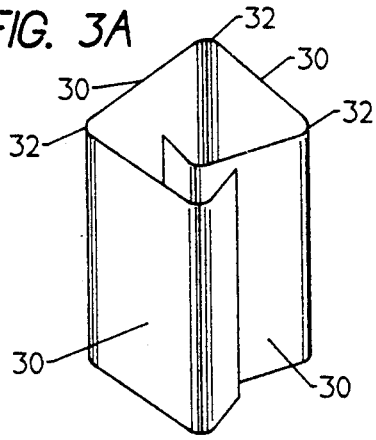
Figure 3B:
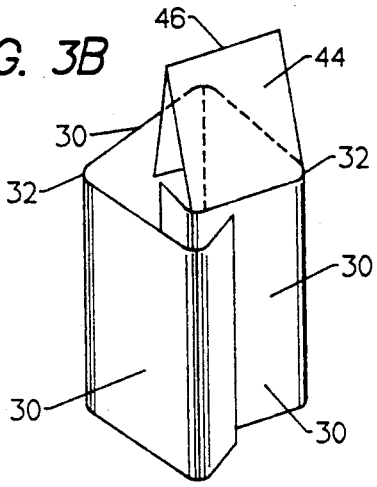

FIG. 3, 3A and 3B illustrate the method of folding the preferred embodiment wall structure 28, consisting of two panel sections 30 and one elastically bendable hinge seam 32. Folding or bending the wall structure about the hinge seam(s) in the method shown allows the entire structure to be passed through the limited width 24 of the elevator door opening 22 and into the hoistway 12. Once the structure is within the hoistway, the structure can be unfolded and readily attached to the platform 16. Installing the structure as an assembled unit allows the peripheral hardware (not shown) to be attached prior to installation at a more economical time. Other configurations comprising more than two panel sections and more than one hinge seam may also be employed. In addition, a roof 44 with a second hinge seam(s) 46 may also be attached to a panel section of the wall structure. After installation of the wall structure within the hoistway, the roof may be further attached to the wall structure by conventional means, for example by nuts and bolts.

Figure 4:
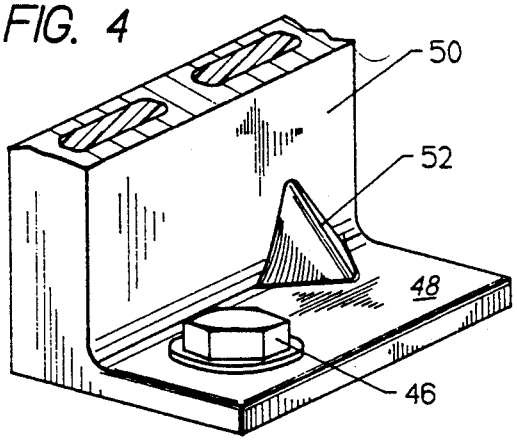
FIGS. 4 and 4A show a flange attached to the base of a panel section of FIG. 2.
Figure 4A:
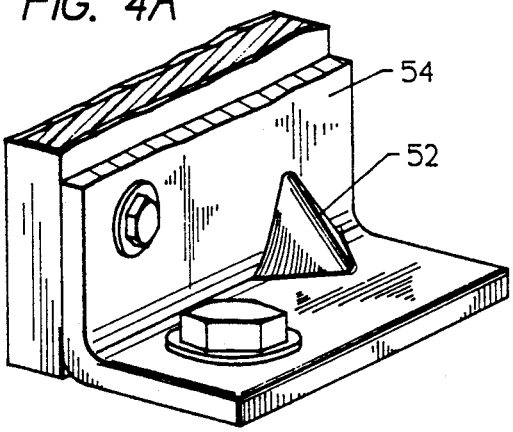

Now referring to FIG. 4 and 4A, once the wall structure 28 has been positioned on the platform 16 within the hoistway 12, it can be secured to the platform by bolts 46, for example. In the preferred embodiment, the bolts pass through a flange 48 integrally molded within the panel sections 30, which extends out from the external surface 50 of the panel sections. The preferred embodiment further includes webbing 52 attached to the flange, spaced at regular intervals, for added strength. In other embodiments, the flange may be a separate device 54 either fastened to (FIG. 4A) or molded within (not shown) the panel sections.

Figure 5:
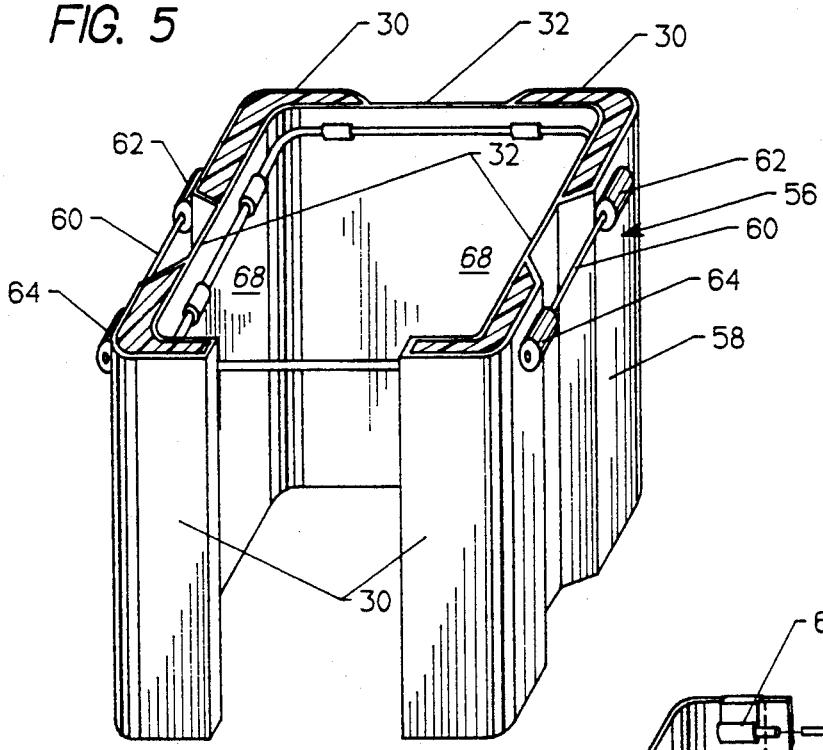
FIG. 5 shows a stiffening assembly attached to the exterior of the wall structure of FIG. 2 as well as a stiffening assembly having a continuous member and lugs attached to the interior walls of the wall structure.
Figure 5A:
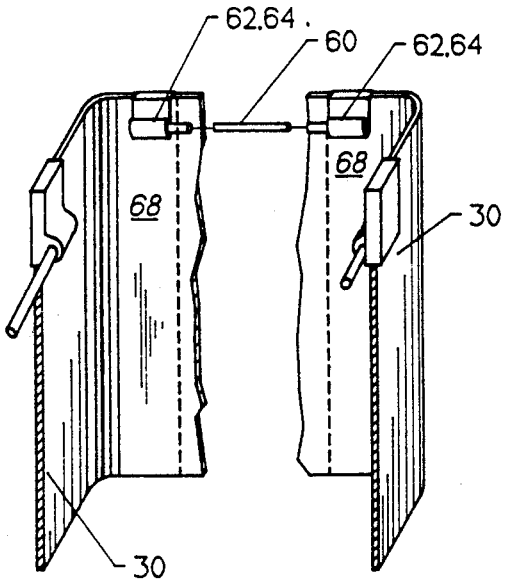
FIG. 5A shows a diagrammatic view of a stiffening assembly attached to the interior walls of a wall structure.

Now referring to FIG. 5 and 5A, in the preferred embodiment, one or more a stiffening assemblies 56 attach to the external surface 58 of the wall structure 28. Each stiffening assembly includes a threaded member 60 and a pair of threaded lugs 62,64 which receive the threaded member. The threaded lugs are fixedly molded into the panel sections 30 of the wall structure, one on each side of the hinge seam 32. Alternatively, the lugs may simply be fastened to the panel sections by conventional means. In another embodiment, one or more stiffening assemblies are employed which do not thread together, but can be tensioned by separate means, for example by nuts independent of the lugs, or a turnbuckle, or a cam design. Once the stiffening assembly(s) is installed, tensioning the assembly adds rigidity to the wall structure. The number of stiffening assemblies required depends on factors such as the number of hinge seams, the configuration of the cab, and the rigidity sought. In a further embodiment, a stiffening assembly comprising lugs and a continuous member 66, which extends around either the inner or outer perimeter of the wall structure, may be used.

Figure 6:
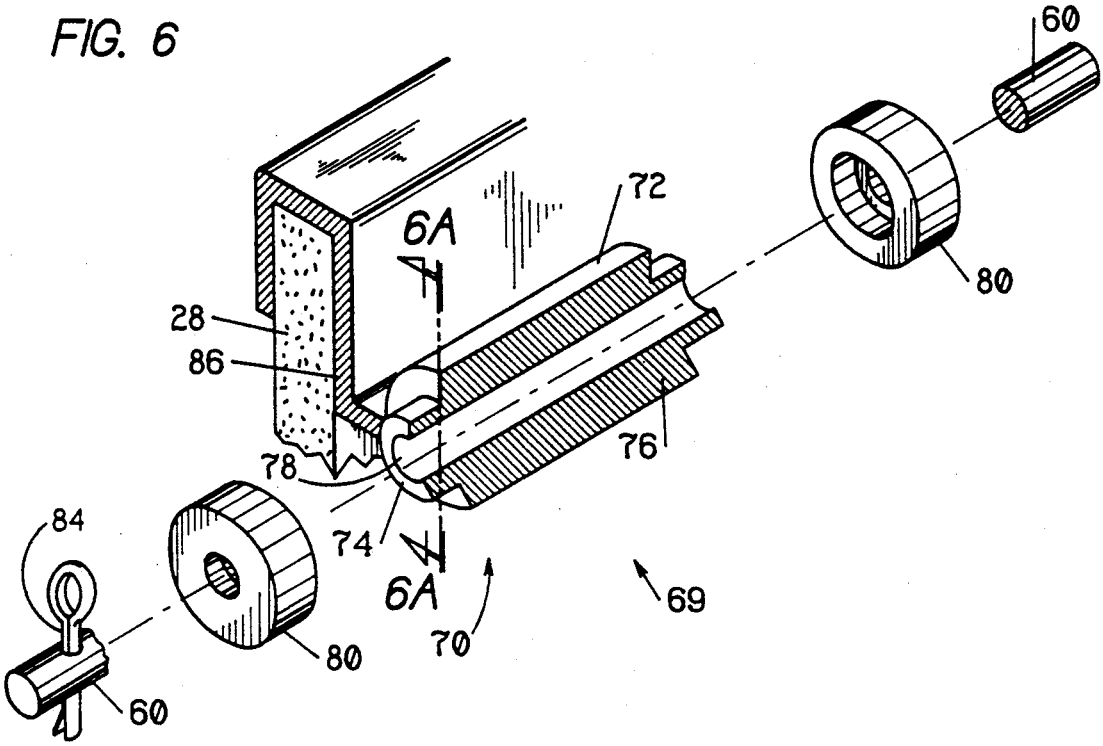
FIG. 6 shows a perspective view of a rod retainer assembly.
Figure 6A:
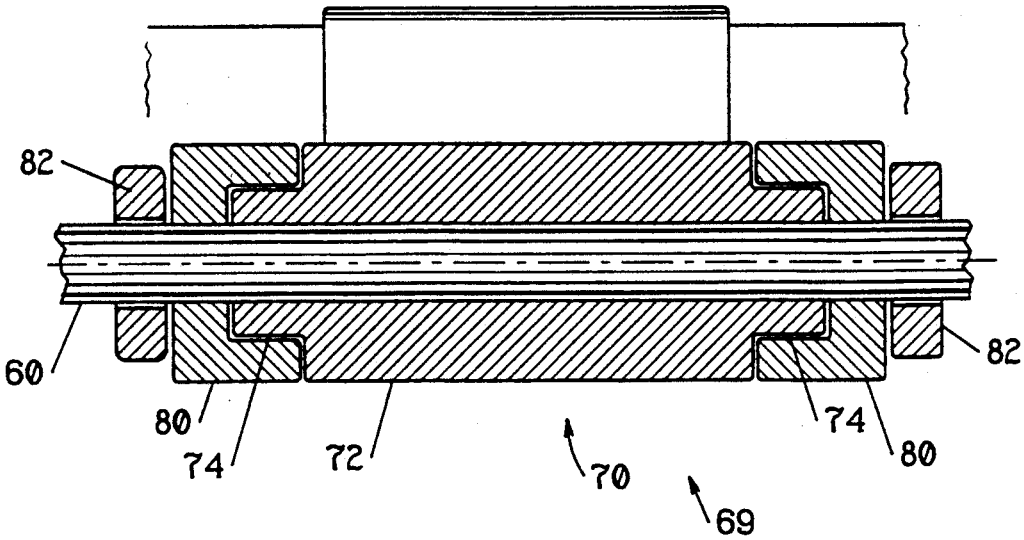
FIG. 6A shows a sectional view of the rod retainer assembly shown in FIG. 6.

Now referring to FIGS. 6 and 6*a*, in one embodiment, the aforementioned lugs 62,64 of the stiffening assembly 56 may be replaced by rod retainer assemblies 69. The rod retainer assemblies include a clasp section 70, which in this embodiment is cylindrical. The clasp section has a bored main body 72 with a cylindrical boss 74 extending out from each end. Alternatively, the bosses may be tapered. A wedge-shaped cutout 76 extends axially along the entire clasp section 70, thereby exposing the center bore 78. At a minimum, the angle of the wedge cutout 76 just allows the rod or threaded member 60 to pass through into the center bore 78. A person skilled in the art will recognize that a variety of different wedge angles may be used.

Once the rod or member 60 is seated in the center bore 78 of the clasp section 70, retaining collars 80, also with a center bore, are moved axially along the member, over the bosses 74, until contact is made with the main body 72. The collars thereby fix the member within the clasp section.

In the preferred embodiment, a pair of nuts 82 (FIG. 6A) secure the collars 80 to the main body 72 of the rod retainer assembly 69, one on each side. The nuts thread onto the threaded member 60. Alternatively, the collars may be secured to the main body by means such as cotter pins 84 (FIG. 6), washers, and spring clips or by other means.

The clasp section 70 attaches to a flange 86 fastened to the wall structure 28 by conventional means such as rivets (not shown). In another embodiment, the clasp section is molded to the wall structure.

Stiffening members may also be attached to the internal surfaces 68 of the wall panel structure in place of external stiffening members, or in combination with them. In a third embodiment, no stiffening assembly is used. The design of the hinge seams, in the third embodiment, is such that when the wall structure is unfolded, the wall structure rigidity is sufficient and requires no additional measures.

Although this invention has been shown and described with respect to detailed embodiments thereof, it will be understood by those skilled in the art that various changes in form and detail thereof may be made without departing from the spirit and scope of the claimed invention.

We claim:

1. A method for assembling an elevator car having a platform, in a hoistway having a door opening, comprising:

forming a wall structure from a homogeneous material, said wall structure comprising a plurality of panel sections and an integrally formed flexible hinge seam formed from said homogeneous material, said hinge seam positioned in between said panel sections;

bending said wall structure about said hinge seam to minimize the dimensions of said structure, thereby allowing said structure to pass through the door opening of the elevator hoistway; and unbending and attaching said wall structure to the platform of the elevator car positioned within the hoistway of the elevator.

2. A method for assembling an elevator car having a platform, in a hoistway having a door opening, comprising:

forming a wall structure from a homogeneous material, said wall structure comprising a plurality of panel sections and an integrally formed flexible hinge seam formed from said homogeneous material, said hinge seam positioned in between said panel sections;

bending said wall structure about said hinge seam to minimize the dimensions of said structure, thereby allowing said structure to pass through the door opening of the elevator hoistway;

unbending and attaching said wall structure to the platform of the elevator car positioned within the hoistway of the elevator; and attaching a stiffening assembly to said wall structure, thereby adding rigidity to said wall structure.

3. A lightweight prefabricated elevator cab, comprising:

a wall structure, formed of a homogeneous material, having a plurality of panel sections, wherein each panel section is connected to another panel section by an integrally formed hinge seam, said hinge seam capable of being elastically deformed; and a stiffening assembly, having a member and a pair of lug, wherein said lugs attached to said panel sections on each of said hinge seam, and receive said member, thereby adding rigidity to said wall structure.

4. A lightweight prefabricated elevator cab according to claim 3, wherein said homogeneous panel sections have a cross-sectional geometry with more than one layer.

5. A lightweight prefabricated elevator cab according to claim 4, wherein said multi-layer design further comprises voids, said voids filled with a filler material.

6. A lightweight prefabricated elevator cab according to claim 3, wherein said homogeneous panel sections have a cross-section geometry of a single layer.

7. A lightweight prefabricated elevator cab according to claim 3, further comprising a roof section formed from said homogeneous material, connected to one of said panel sections by a hinge seam integrally attached to said panel section and formed of said homogeneous material, said hinge seam capable of being elastically deformed.

8. A lightweight prefabricated elevator cab, formed of a composite material comprising:

a wall structure, formed of a homogeneous material, having a plurality of panel sections, wherein each panel section is connected to another panel section by an integrally formed hinge seam, said hinge seam capable of being elastically deformed; and a stiffening assembly, having a member and a pair of lug, wherein said lug attached to said panel sections on each of said hinge seam, and receive said member, thereby adding rigidity to said wall structure.

9. A lightweight prefabricated elevator cab formed of a composite material according to claim 8, wherein said homogeneous panel sections have a cross-sectional geometry with more than one layer.

10. A lightweight prefabricated elevator cab formed of a composite material according to claim 9, wherein said multi-layer design further comprises voids, said voids filled with a filler material.

11. A lightweight prefabricated elevator cab formed of a composite material according to claim 8, wherein said homogeneous panel sections having a cross-section geometry of a single layer.

12. A lightweight prefabricated elevator cab according to claim 8, further comprising a roof section formed from said homogeneous material, connected to one of said panel sections by a hinge seam integrally attached to said panel section and formed of said homogeneous material, said hinge seam capable of being elastically deformed.

* * * * *